US009334639B2

(12) United States Patent
Lenko

(10) Patent No.: US 9,334,639 B2
(45) Date of Patent: May 10, 2016

(54) DRAIN BOX ASSEMBLY FOR A CONVERTIBLE SPLASH PAD/ICE RINK STRUCTURE

(71) Applicant: Custom Ice Inc., Burlington (CA)

(72) Inventor: Brendan Lenko, Hamilton (CA)

(73) Assignee: Custom Ice Inc., Burlington, Ontario (CA)

( * ) Notice: Subject to any disclaimer, the term of this patent is extended or adjusted under 35 U.S.C. 154(b) by 0 days.

(21) Appl. No.: 14/585,568

(22) Filed: Dec. 30, 2014

(65) Prior Publication Data

US 2015/0107694 A1 Apr. 23, 2015

(30) Foreign Application Priority Data

Jan. 15, 2014 (CA) ..... 2839144

(51) Int. Cl.

| | |
|---|---|
| ***E03C 1/22*** | (2006.01) |
| ***E01C 13/02*** | (2006.01) |
| ***E01C 13/10*** | (2006.01) |
| ***A63C 19/10*** | (2006.01) |
| ***E04H 4/14*** | (2006.01) |
| ***F25C 3/02*** | (2006.01) |

(52) U.S. Cl.

CPC . *E03C 1/22* (2013.01); *A63C 19/10* (2013.01); *E01C 13/02* (2013.01); *E01C 13/105* (2013.01); *E04H 4/14* (2013.01); *F25C 3/02* (2013.01); *Y10T 137/6991* (2015.04)

(58) Field of Classification Search

CPC ..... F25C 3/02; F25C 5/182; F25C 2500/06; F28D 1/06; F28D 3/02; F28F 7/02; F28F 9/0246; F28F 17/00; E01C 13/102; E01C 13/105; E01H 4/023; A63C 19/10

USPC ..... 62/235, 312, 313, 319, 398, 422, 460

See application file for complete search history.

(56) References Cited

U.S. PATENT DOCUMENTS

| | | | | |
|---|---|---|---|---|
| 2,542,543 A | | 2/1951 | Losee | |
| 3,930,347 A | | 1/1976 | Megumi | |
| 4,083,400 A | * | 4/1978 | Dziedzic | F28D 9/0037 165/135 |

(Continued)

FOREIGN PATENT DOCUMENTS

| | | | | |
|---|---|---|---|---|
| CA | 2162528 | | 5/1996 | |
| PT | GB 2500578 A | * | 10/2013 | E04H 4/129 |

(Continued)

*Primary Examiner* — Judy Swann

*Assistant Examiner* — Zachary R Anderegg

(74) *Attorney, Agent, or Firm* — Patrick J. Hofbauer; Kevin E. Holbeche

(57) ABSTRACT

A drain box assembly for a convertible splash pad/ice rink structure comprises a housing having an open top and a closed bottom, sidewalls connecting the top and bottom of the housing in fluid sealing relation to form within the housing a vertically directed water flow channel that connects a water ingress port and a water egress port in fluid communication one with the other. Connectors operatively secure the housing at the water egress port to a drain pipe. A plurality of coolant pipe segments each have an axis of symmetry extending between a first open end and a second open end. The coolant pipe segments are mounted on the housing to extend through the vertically directed water flow channel adjacent the open top, in substantially transverse relation to the vertical water flow channel. The first and second open ends of each coolant pipe segment extend beyond the one or more upright walls.

23 Claims, 19 Drawing Sheets

(56) References Cited

U.S. PATENT DOCUMENTS

| | | | | |
|---|---|---|---|---|
| 4,467,619 | A * | 8/1984 | Kovach | E01C 13/105 165/45 |
| 4,663,036 | A | 5/1987 | Strobl, Jr. et al. | |
| 5,268,096 | A | 12/1993 | Robol | |
| 5,536,411 | A | 7/1996 | Blades | |
| 5,709,099 | A * | 1/1998 | Blades | F25C 3/02 165/53 |
| 6,021,646 | A | 2/2000 | Burley et al. | |
| 6,093,314 | A | 7/2000 | Wilson et al. | |
| 6,170,278 | B1 * | 1/2001 | Jorgensen | E01C 13/105 472/92 |
| 6,586,674 | B2 | 7/2003 | Krause et al. | |
| 6,810,537 | B1 | 11/2004 | Barnes et al. | |
| 7,980,914 | B1 | 7/2011 | Blais et al. | |
| 8,486,260 | B2 | 7/2013 | Tripodi et al. | |
| 2003/0016638 | A1 * | 1/2003 | Philips | B01J 19/0093 370/329 |
| 2003/0172657 | A1 * | 9/2003 | Ohkubo | F25B 21/04 62/3.3 |
| 2005/0069386 | A1 | 3/2005 | Happel et al. | |
| 2006/0124287 | A1 * | 6/2006 | Reinders | F24F 5/0035 165/166 |
| 2007/0125108 | A1 * | 6/2007 | Lenko | A63C 19/10 62/235 |
| 2010/0077681 | A1 | 4/2010 | McCleskey | |
| 2011/0239362 | A1 | 10/2011 | Jacobs | |
| 2012/0125108 | A1 * | 5/2012 | Muravin | G01N 29/043 73/587 |
| 2012/0273171 | A1 * | 11/2012 | Upadhya | F28D 3/02 165/121 |
| 2013/0140012 | A1 * | 6/2013 | Al-Otaibi | F28F 9/0202 165/174 |
| 2014/0251585 | A1 * | 9/2014 | Kusuda | F28D 1/06 165/164 |

FOREIGN PATENT DOCUMENTS

| | | | |
|---|---|---|---|
| WO | WO 2009/075587 | A1 | 6/2009 |
| WO | WO 2011/034220 | A1 | 3/2011 |

* cited by examiner

DRAIN BOX ASSEMBLY FOR A CONVERTIBLE SPLASH PAD/ICE RINK STRUCTURE

FIELD OF THE INVENTION

This invention relates to drain box assemblies, and more particularly relates to drain box assemblies for convertible splash pad/ice rink structures.

BACKGROUND OF THE INVENTION

Wading pools, concrete splash pads, and the like are filled with a few inches of water during suitably warm weather, typically a summer season, in order to provide a shallow water-filled structure for young children and others to play in. Unlike regular swimming pools, the water in wading pools and splash pads is not constantly re-circulated, but is instead drained frequently, typically daily. For the purposes of convenience, brevity and clarity, such wading pools and splash pads will be referred to as splash pads henceforth in this document.

It is known in the prior art to convert such splash pads to an ice skating rink during the winter season, hereinafter referred to as a "convertible splash pad/ice rink structure". Such a converted splash pad/ice rink structure can typically be used for pleasure skating, or for hockey.

A typical convertible splash pad/ice rink structure comprises a concrete base having a generally planar upper surface and a raised peripheral rim of about two to six inches, to retain water thereon. The planar surface may be entirely flat, but is more typically sloped slightly towards a plurality of drains formed in the concrete base to assist with water flow to the drains. Convertible splash pad/ice rink structures may be any suitable size. Typically, convertible splash pad/ice rink structures having a circular plan outline range anywhere from about twenty feet to about one hundred feet in diameter, and convertible splash pad/ice rink structures having a quadrilateral plan outline range anywhere from about thirty feet (30') by sixty feet (60') to about sixty feet (60') by one hundred twenty feet (120').

In order to provide the necessary cooling for the formation and maintenance of ice atop the concrete base during the skating season, coolant pipes having a diameter of about a half inch (0.5") to about one inch (1.0") are typically put in place during construction of the concrete base. These coolant pipes are typically constructed from a robust plastics material, and are laid out in a parallel pattern with the ends of the pipes connected one to the next at alternating ends in order to form a continuous piping system connected to the pumps and/or compressor of a refrigeration system. In forming the parallel pattern, the coolant pipes are typically laterally spaced about one and one-half inches (1.5") to about four inches (4.0") inches apart from each other in order to provide adequate and even cooling of the ice surface that is formed above the upper surface of the concrete base when the skating rink is in use.

In order to facilitate frequent drainage of the splash pad in an acceptable period of time during the swimming season, it is common to utilize a plurality of drains in the concrete base. The exact number of drains reasonably required depends on the size of the convertible splash pad/ice rink structure. Each drain terminates its top end in a drain box, which is typically, but not essentially, square in plan outline. The drain boxes and drains can advantageously, from the standpoint of quick drainage, be of a relatively large size. Typically, the drains can be up to perhaps eight inches (8.0") in diameter and the drain boxes can be up to perhaps sixteen inches (16.0") in width or diameter.

One significant consideration in determining the size and number of drains and drain boxes to be used in a convertible splash pad/ice rink is that of cost of installation. Each of the drains provided must be in fluid communication with a respective drain pipe buried in the ground below the concrete base. Further, each drain pipe connects to a common drainage system. The construction of a system of numerous drain boxes and drain pipes is typically quite expensive. Accordingly, from a cost standpoint, it is desirable to use fewer larger drain boxes as opposed to a greater number of smaller drain boxes.

However, the use of larger drain boxes causes a significant problem with respect to conventional splash pad/ice rink structures. This is so, as larger drains and drain boxes present a sizeable disruption in the upper surface of the concrete base of the convertible splash pad/ice rink structure. Accordingly, portions of the in-ground coolant pipes in the vicinity of each drain must be diverted from their normal parallel paths (where they are typically spaced apart one from the next by about one and a half inches (1.5") to about four inches (4.0")), to bend around the drain boxes so as to accommodate placement of the drain boxes in the concrete base between the coolant pipes. Accordingly, the use of large drains and drain boxes is not a satisfactory solution for convertible splash pad/ice rink structures, as they create correspondingly large "warm spots" in the ice formed above the drains during the skating season, due to the aforesaid diversion of the in-ground coolant pipes around the drain boxes. Such warm spots can be dangerous to skaters using the ice surface, and therefore are highly undesirable, and even unacceptable.

Exacerbating this problem is the fact that the drains that extend downwardly from each of the plurality of drain boxes each act as a "cooling sink", to draw refrigerated cold away from the concrete base and the ice surface. As such, "warm spots" caused by the drains positioned in the upper surface of convertible splash pad/ice rink structures are a significant problem in the prior art that has yet to be satisfactorily addressed.

It is an object of the present invention to provide a drain box assembly for a convertible splash pad/ice rink structure that substantially eliminates this problem in association with prior art drain boxes for convertible splash pad/ice rink structures It is another object of the present invention to provide a drain box assembly for a convertible splash pad/ice rink structure, wherein the amount of work necessary to construct and connect all of these drains, and the cost associated therewith, are both reduced significantly as compared to the prior art usage of a relatively larger number of smaller sized drain boxes.

It is yet a further object of the present invention to provide a drain box assembly for a convertible splash pad/ice rink structure, that substantially eliminates "warm spots" in the ice formed above the drains during the winter season, while also providing for quick and efficient drainage of water covering the upper surface of a convertible wading pool during the swimming season.

It is still a further object of the present invention to provide a drain box assembly for a convertible splash pad/ice rink structure, wherein the problem of the drain pipes that extend downwardly from each of the plurality of drains acting as a "cooling sink", is precluded, or at least substantially ameliorated.

SUMMARY OF THE INVENTION

In accordance with one aspect of the present invention there is disclosed a novel drain box assembly for a convertible splash pad/ice rink structure having a plurality of in-ground coolant pipes. The drain box assembly comprises a housing having an open top and a closed bottom, a water ingress port formed by the open top of the housing and a water egress port adjacent the bottom of the housing. One or more upright walls connect the open top and bottom of the housing in fluid sealing relation to form within the housing a vertically directed water flow channel connecting the water ingress port and the water egress port in fluid communication one with the other. At least one connector is mounted on the housing for operatively securing the housing at the water egress port to a drain pipe installed in the ground. A plurality of coolant pipe segments each having a first open end and a second open end such that the first open end and the second open end are in fluid communication one with the other to define for each coolant pipe segment an axis of symmetry extending between the first open end and the second open end. The plurality of coolant pipe segments are each mounted on the housing so as to extend across the housing adjacent the open top and through the vertically directed water flow channel, in substantially transverse relation to the vertical water flow channel, with the first and second open ends of each coolant pipe segment extending beyond the one or more upright walls.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described herein below.

BRIEF DESCRIPTION OF THE DRAWINGS

The novel features which are believed to be characteristic of the drain box assembly according to the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only, and are not intended as a definition of the limits of the invention. In the accompanying drawings.

DETAILED DESCRIPTION OF THE ILLUSTRATED EMBODIMENT

Figure 1:
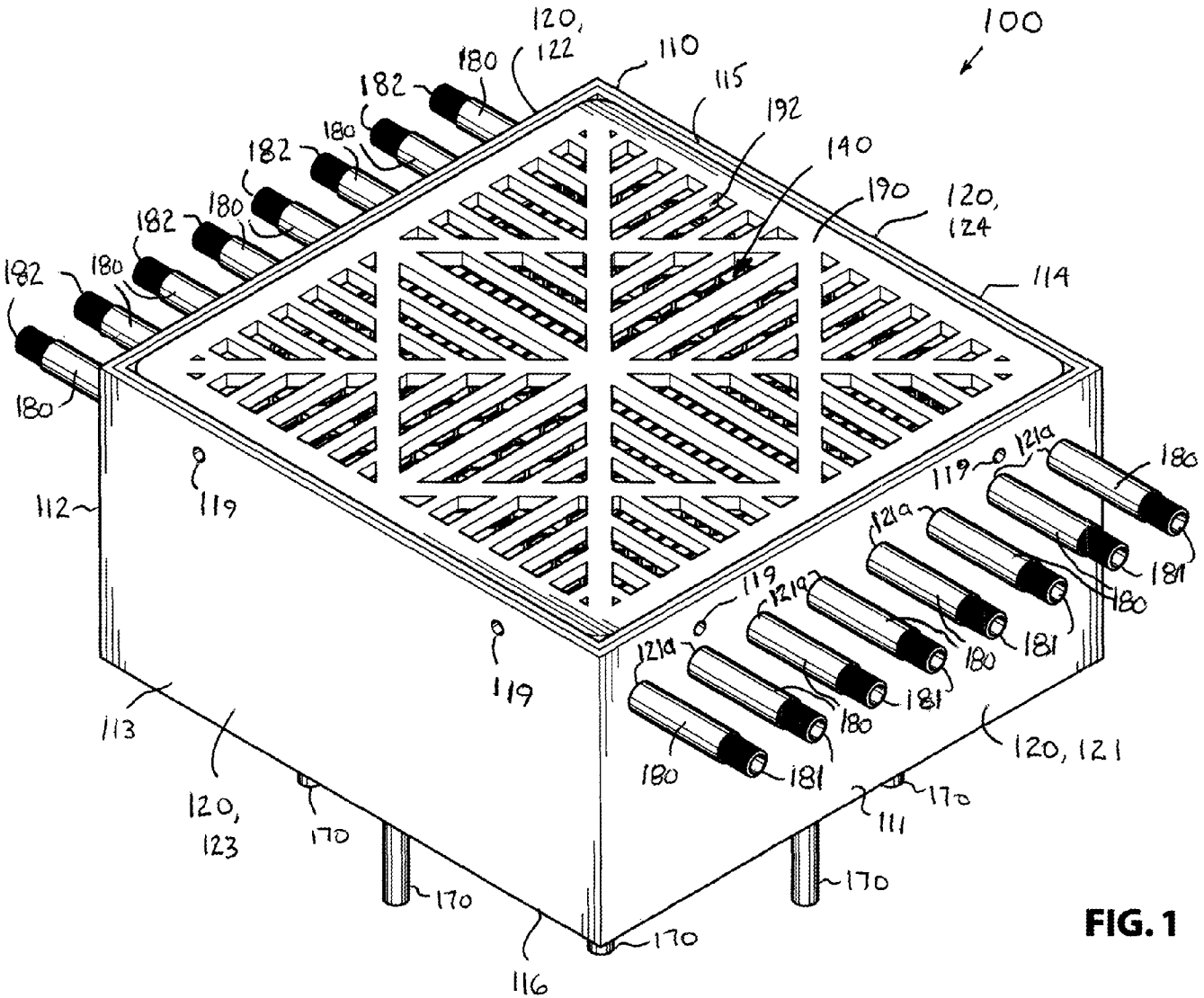
FIG. 1 is a perspective view from above of an illustrated embodiment of drain box assembly according to the present invention.
Figure 2:
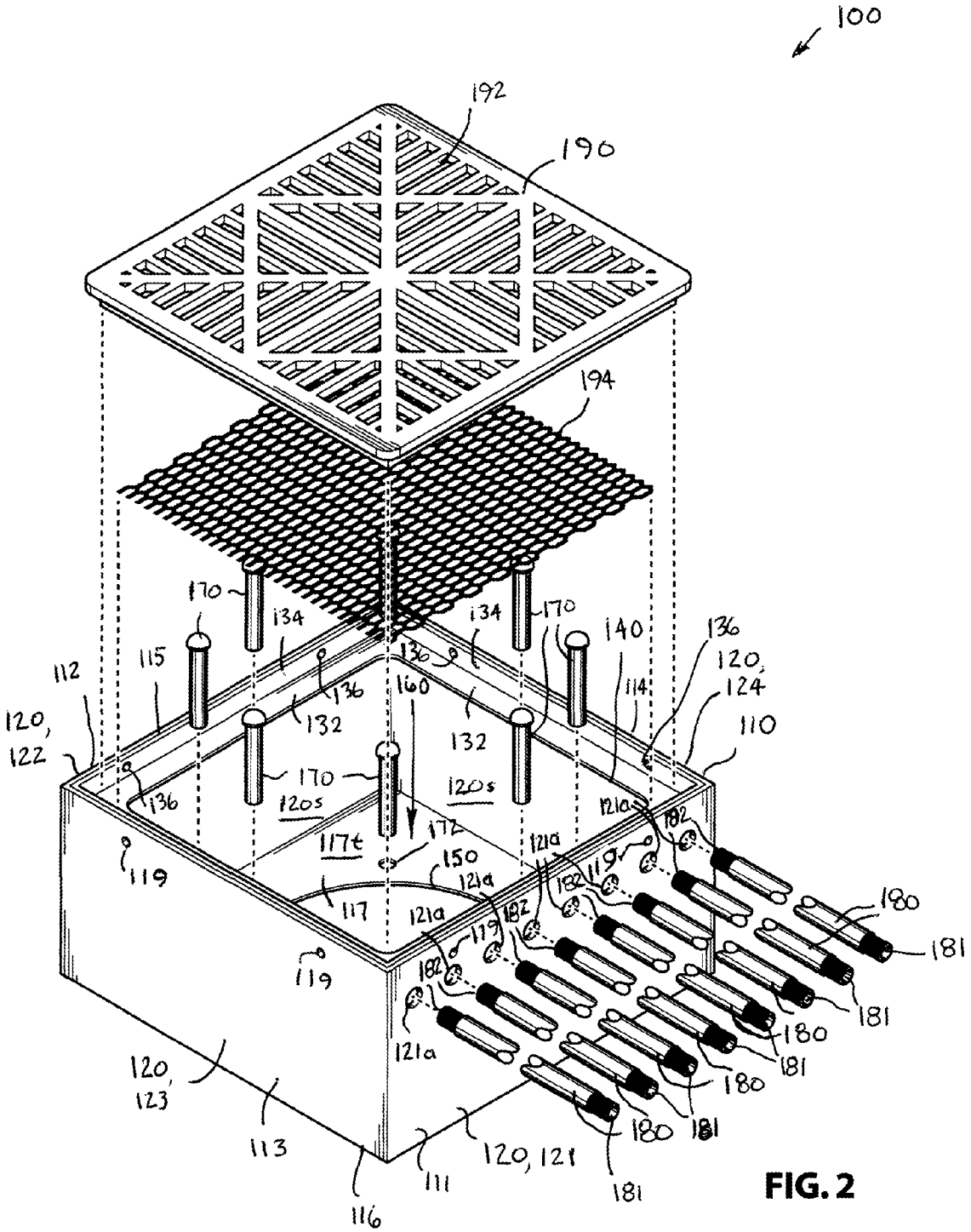
FIG. 2 is an exploded perspective view from above of the illustrated embodiment of the drain box assembly of FIG. 1.
Figure 3:
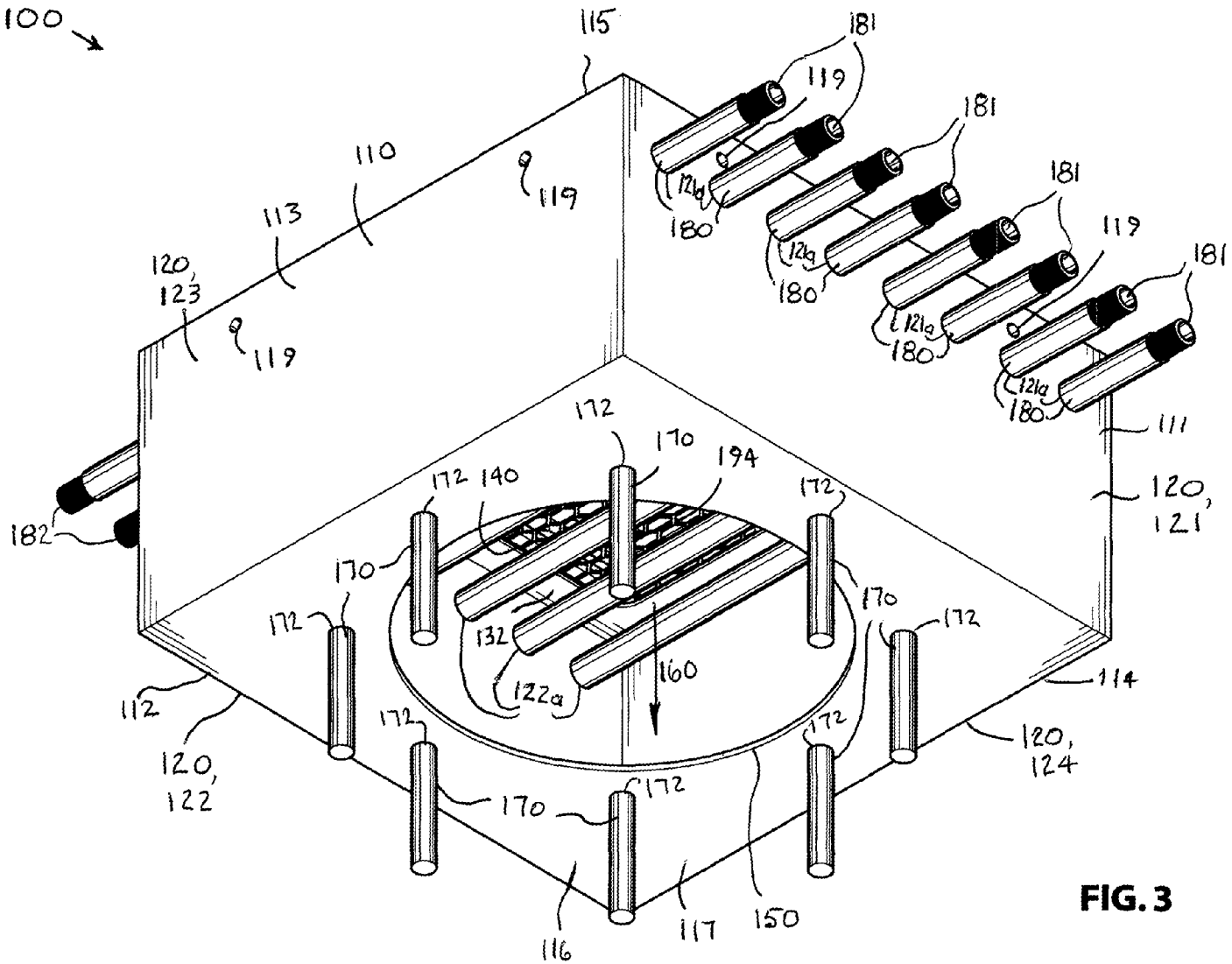
FIG. 3 is a perspective view from below of the illustrated embodiment of the drain box assembly of FIG. 1.
Figure 4:
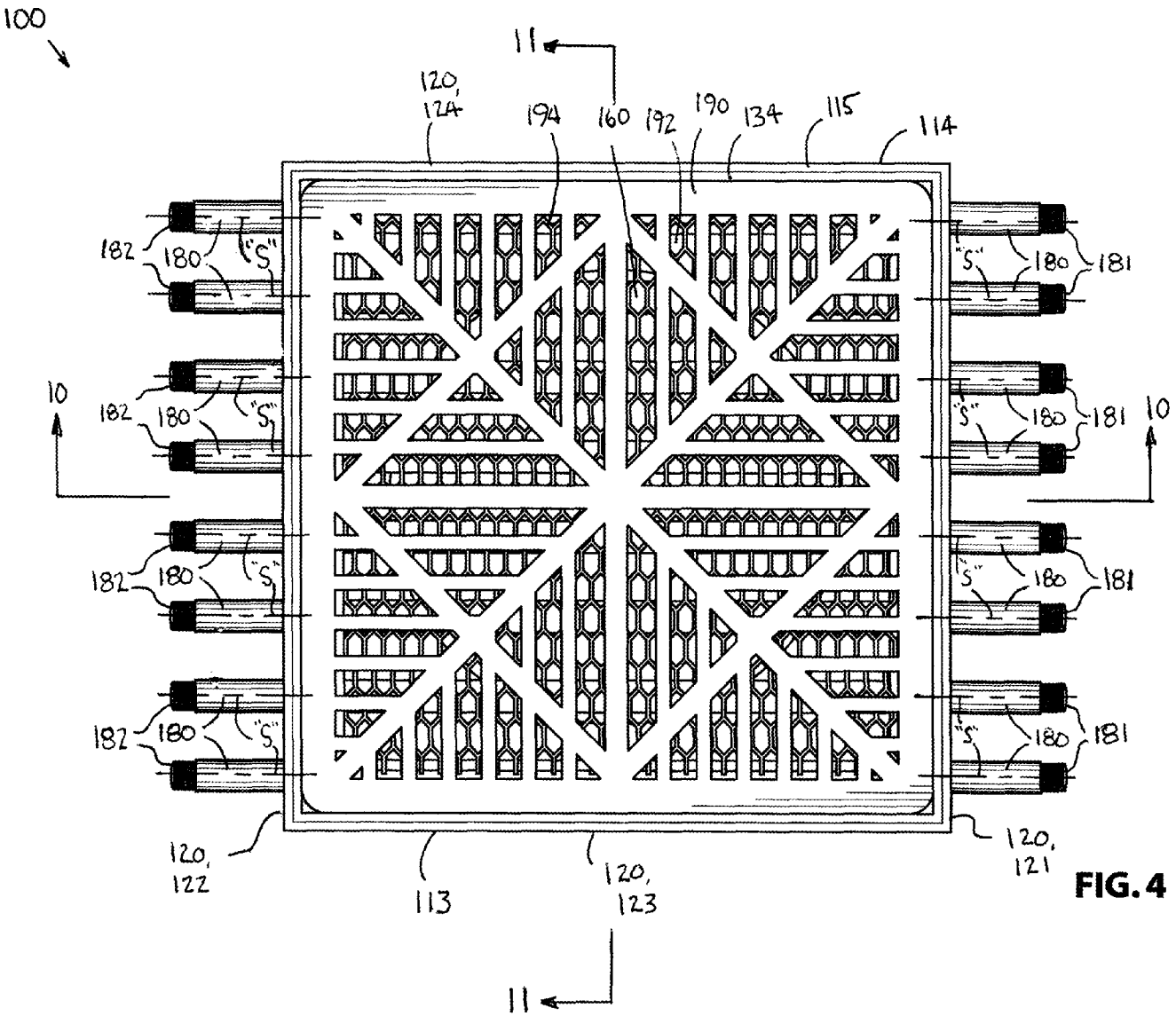
FIG. 4 is top plan view of the illustrated embodiment of the drain box assembly of FIG. 1.
Figure 5:
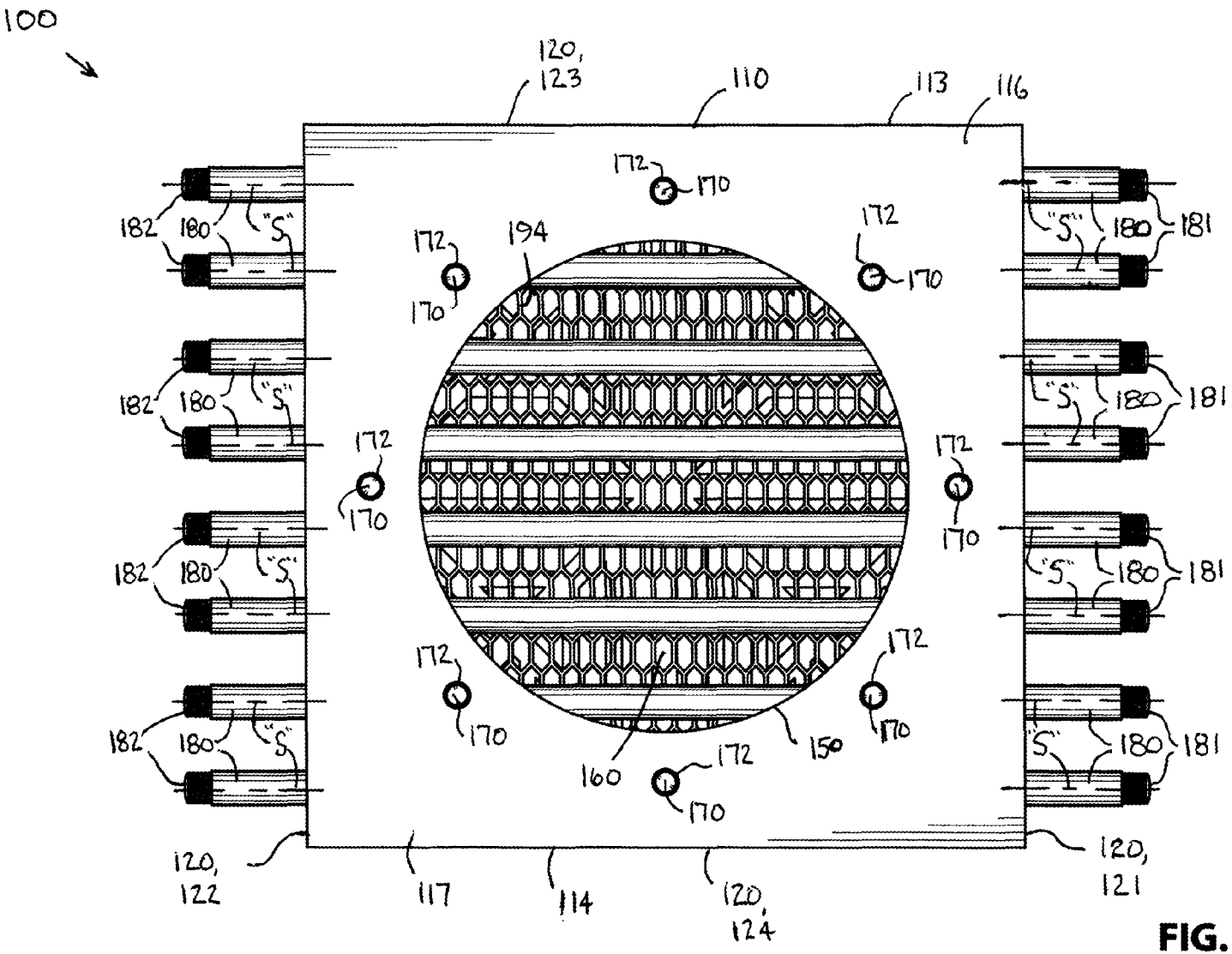
FIG. 5 is a bottom plan view of the illustrated embodiment of the drain box assembly of FIG. 1.
Figure 6:
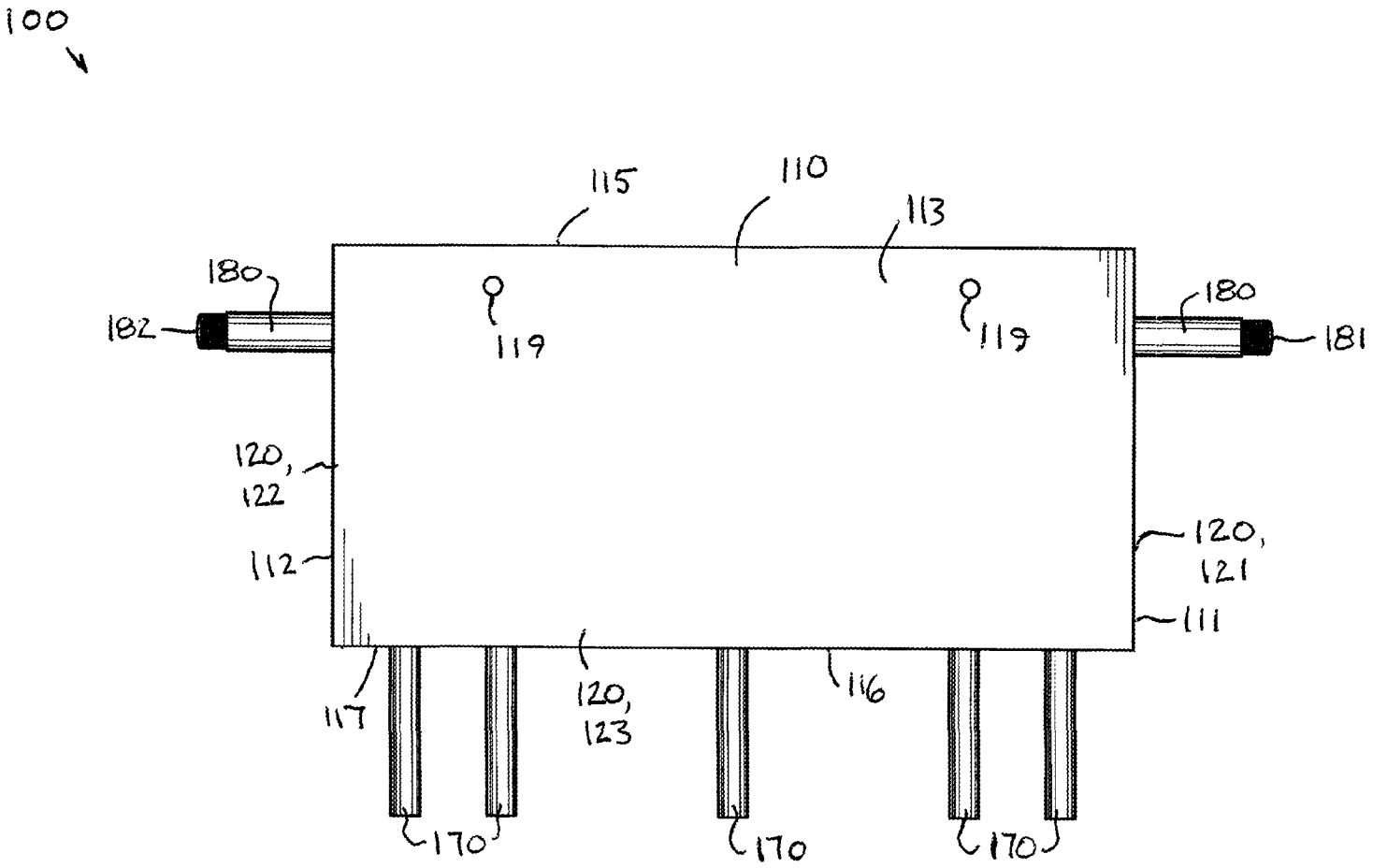
FIG. 6 is a left side elevational view of the illustrated embodiment of the drain box assembly of FIG. 1.
Figure 7:
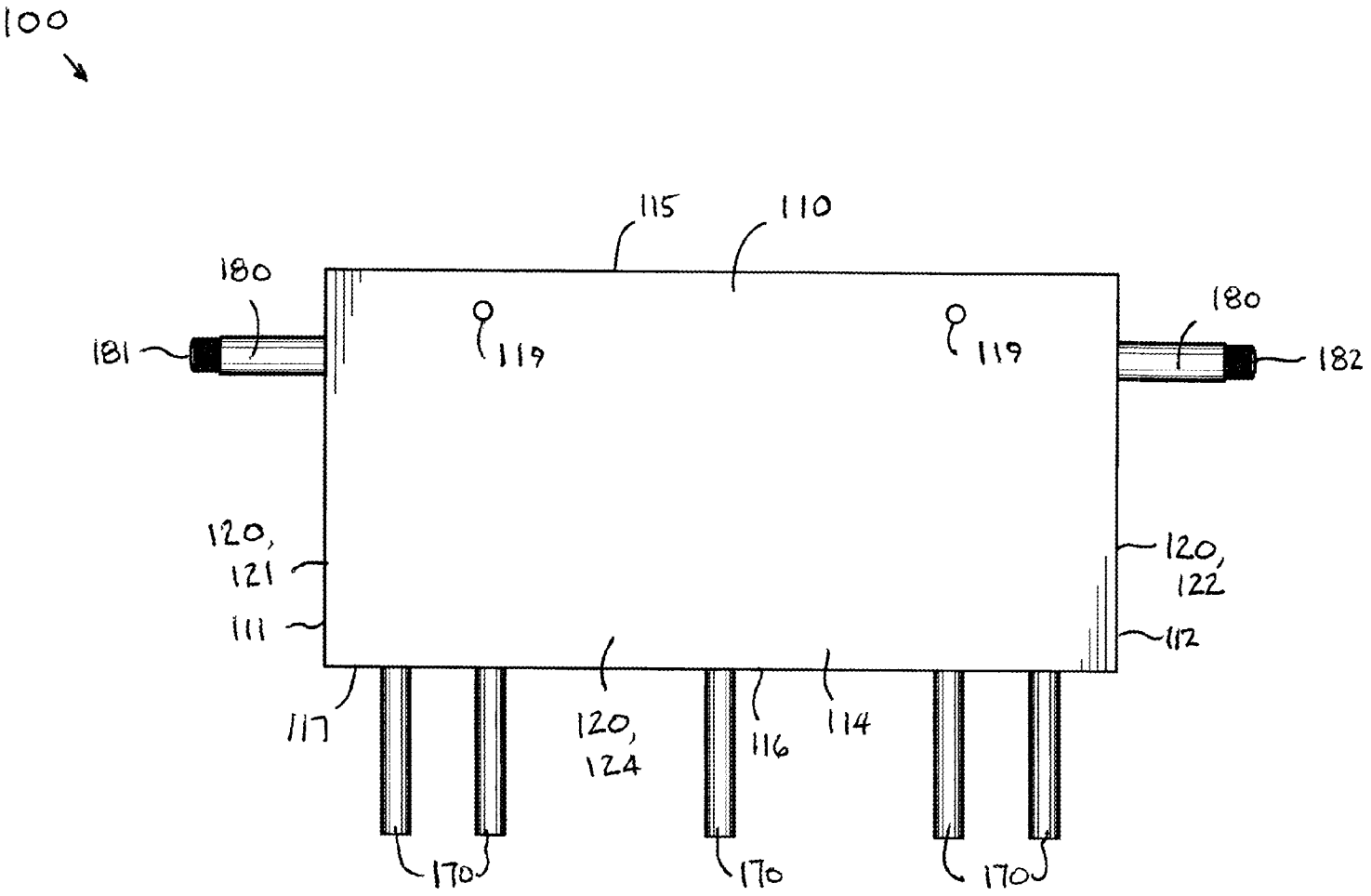
FIG. 7 is a right side elevational view of the illustrated embodiment of the drain box assembly of FIG. 1.
Figure 8:
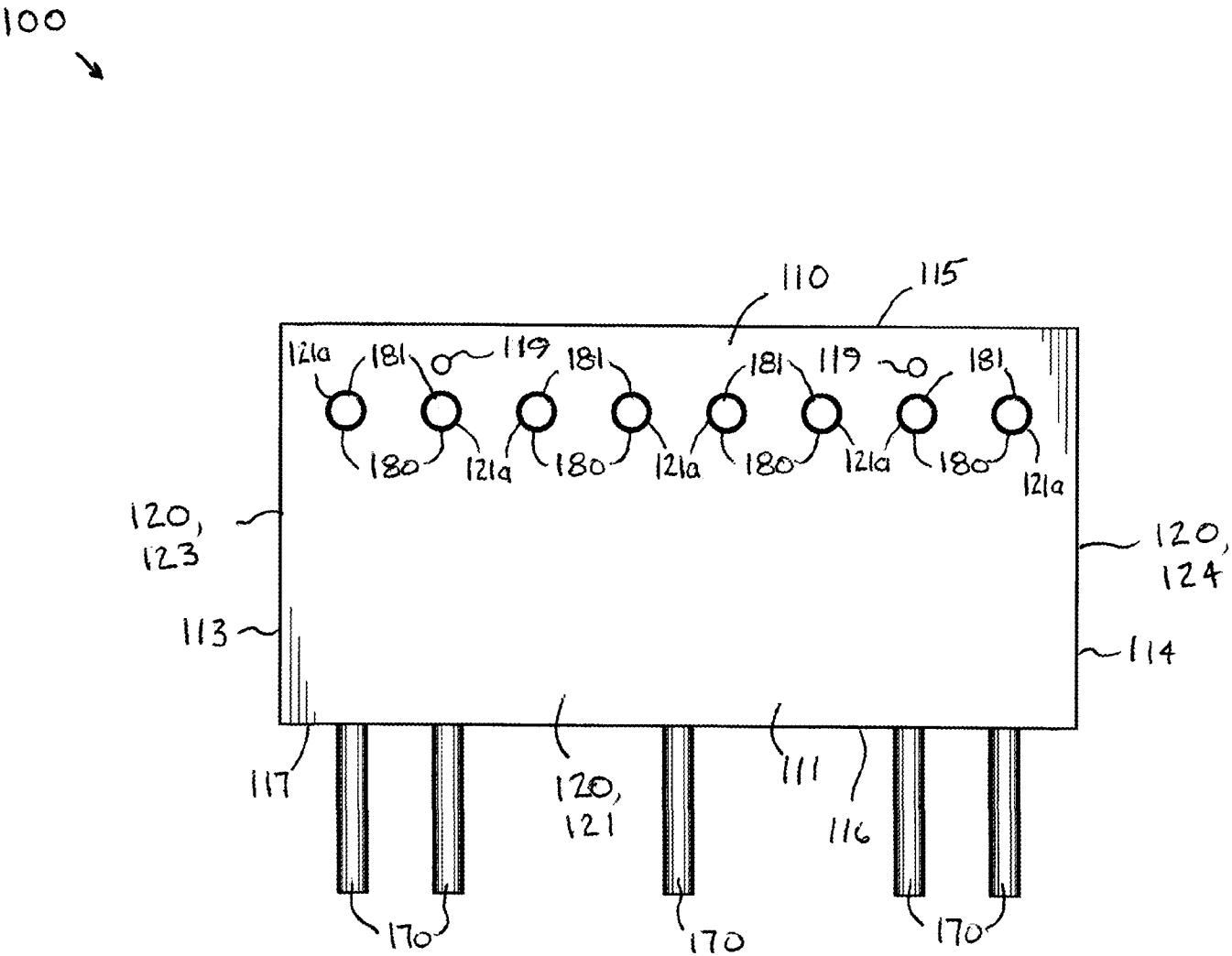
FIG. 8 is a first end view of the illustrated embodiment of the drain box assembly of FIG. 1.
Figure 9:
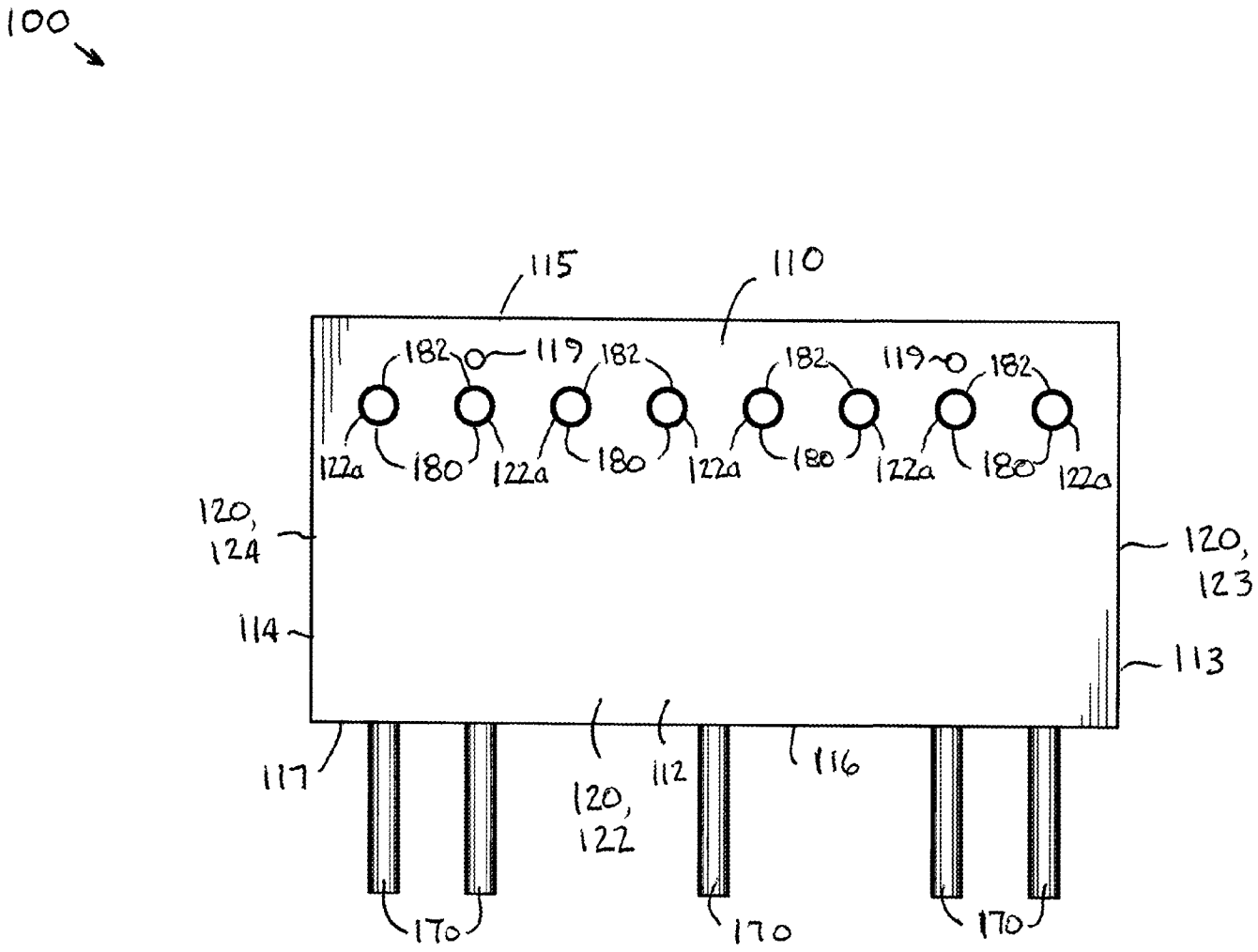
FIG. 9 is a second end view of the illustrated embodiment of the drain box assembly of FIG. 1.
Figure 10:
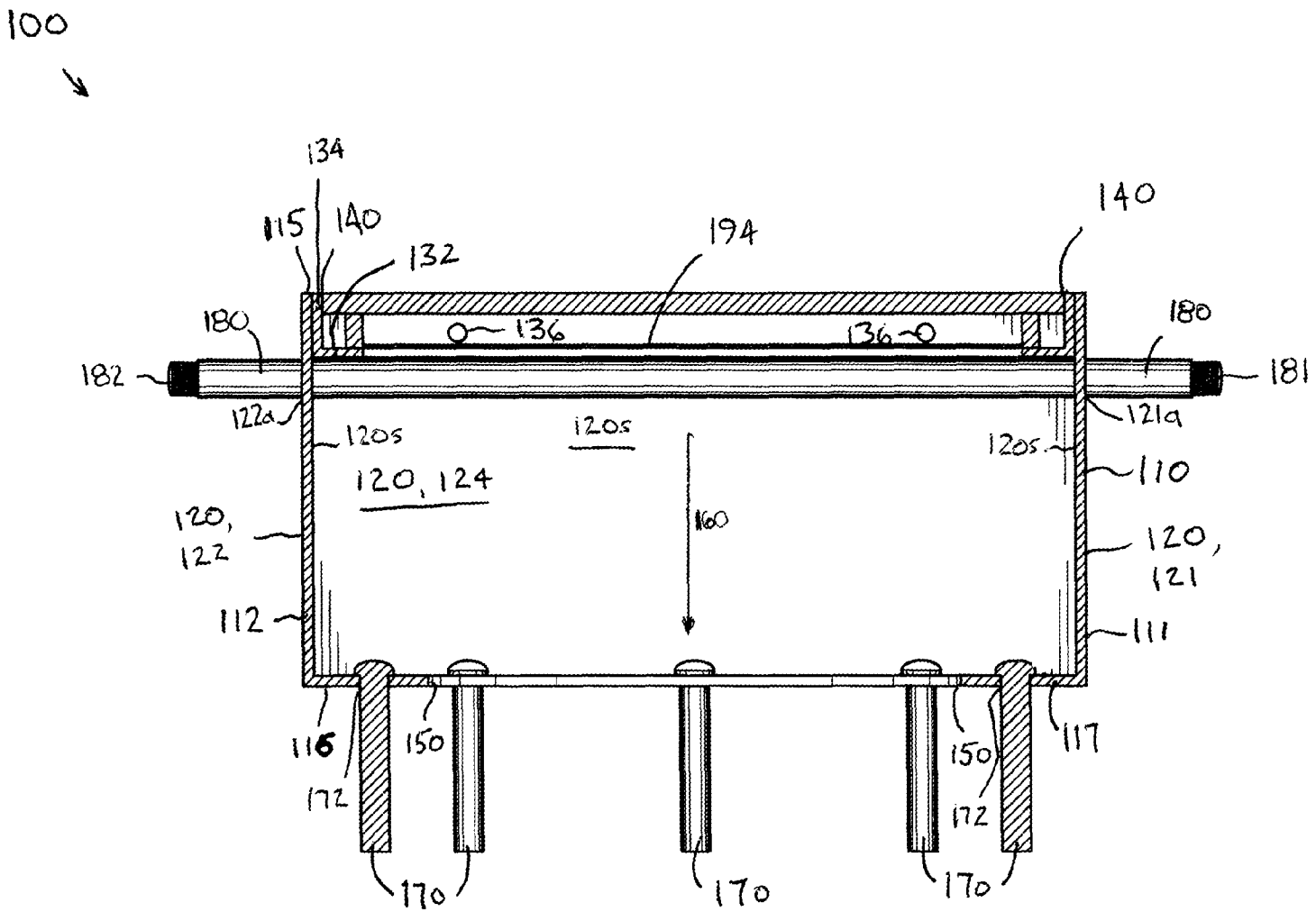
FIG. 10 is a sectional side elevational view of the illustrated embodiment of the drain box assembly of FIG. 1, taken along section line 10-10 of FIG. 4.
Figure 11:
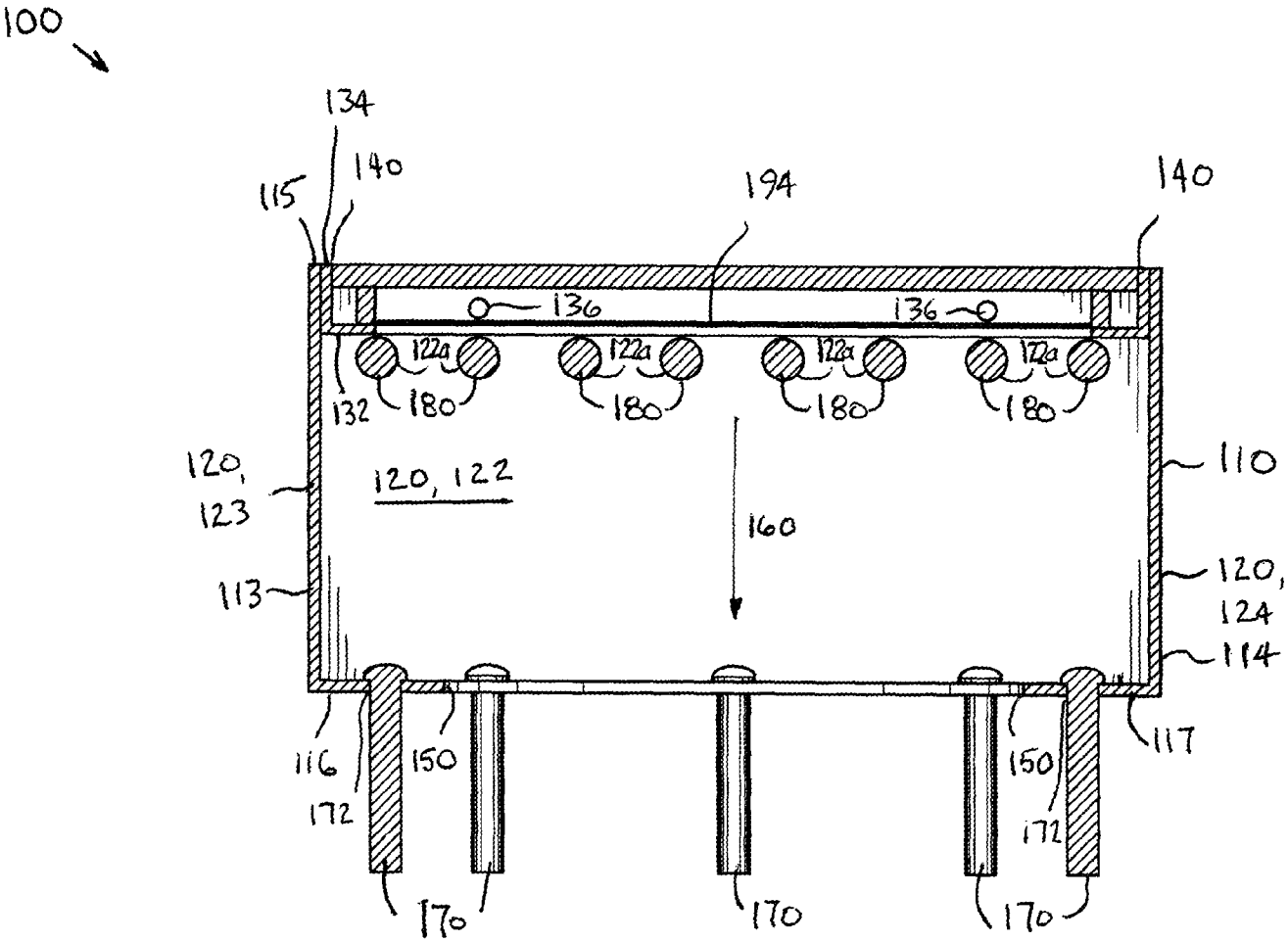
FIG. 11 is a sectional end elevational view of the illustrated embodiment of the drain box assembly of FIG. 1, taken along section line 11-11 of FIG. 4.

Reference will now be made by way of non-limiting example only to FIGS. 1 through 19, which show an illustrated embodiment of the drain box assembly according to the present invention, and as indicated by general reference numeral 100, and its various components. The drain box assembly 100 is for a convertible splash pad/ice rink structure having a concrete base structure 102, as best seen in FIGS. 12 through 17, having a plurality of in-ground coolant pipes 104, as best seen in phantom outline in FIG. 15. These in-ground coolant pipes 104 are typically, but not essentially, straight and oriented in a parallel pattern, with the in-ground coolant pipes 104 being substantially evenly spaced one from the next. While older installations utilized metal in-ground coolant pipes 104, almost all modern installations utilize plastic in-ground coolant pipes 104.

In brief, the drain box assembly 100 comprises a housing 110 having four upright walls 120, a water ingress port 140, a water egress port 150, a vertically directed water flow channel 160, at least one connector 170, a plurality of coolant pipe segments 180, and a drain box cover 190.

More specifically, the drain box assembly 100 comprises a housing 110 having a first end 111, a second end 112, a first side 113, a second side 114, a top 115 and a bottom 116. There are one or more upright walls 120 connecting the top 115 and bottom 116. In the illustrated embodiment, the housing 110 is substantially square in plan outline, and the one or more upright walls 120 comprise four substantially vertical walls, namely a first end wall 121, a second end wall 122, a first side wall 123 and a second side wall 124. The four substantially vertical walls 120 are substantially planar and are oriented at right angles one to the next to form a continuous wall structure. The first end wall 121 is disposed at the first end 111 of the housing 110 and the second end wall 122 is disposed at the second end 112 of the housing 110. Further, the first side wall 123 is disposed at the first side 113 of the housing 110 and the second side wall 124 is at the second side 114 of the housing 110. This housing geometry is entirely optional. For example, the four upright walls 121, 122, 123, and 124, could be replaced by a single continuous cylindrical wall (not shown).

The housing 110 also includes a substantially flat bottom floor 117 disposed at the bottom of the housing 110. The bottom floor 117 is connected to the four walls 120, and structurally interconnects the four walls 120, to form a continuous structure. The housing 110 is preferably made from a suitable anti-corrosive metal material, such as, for example, stainless steel, or powder coated steel, so as to resist corrosion from, for example, chlorine sanitizers often present in the water used to fill splash pads.

Figure 12:
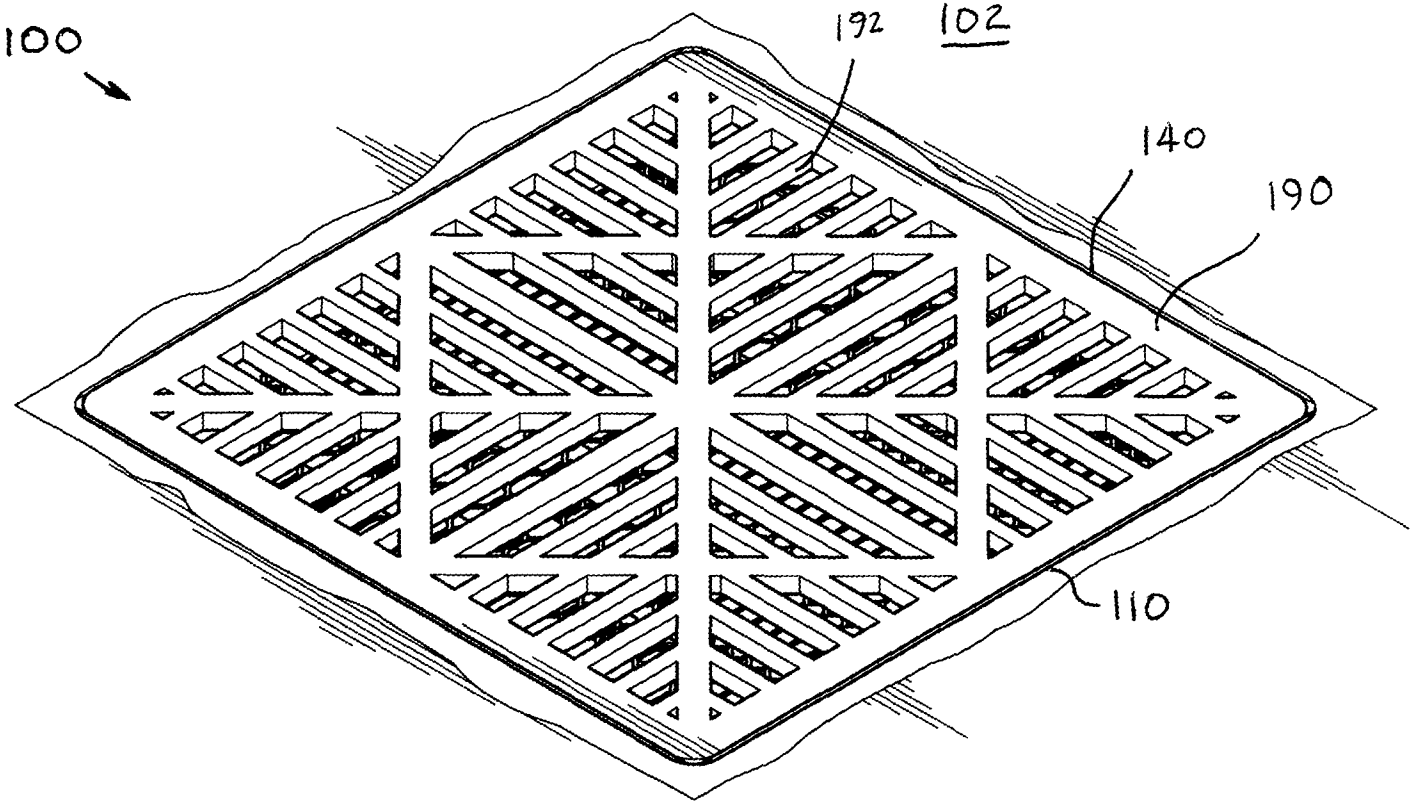
FIG. 12 is a perspective view from above of the illustrated embodiment of the drain box assembly of FIG. 1, installed in place in the concrete base of a convertible splash pad/ice rink structure.
Figure 13:
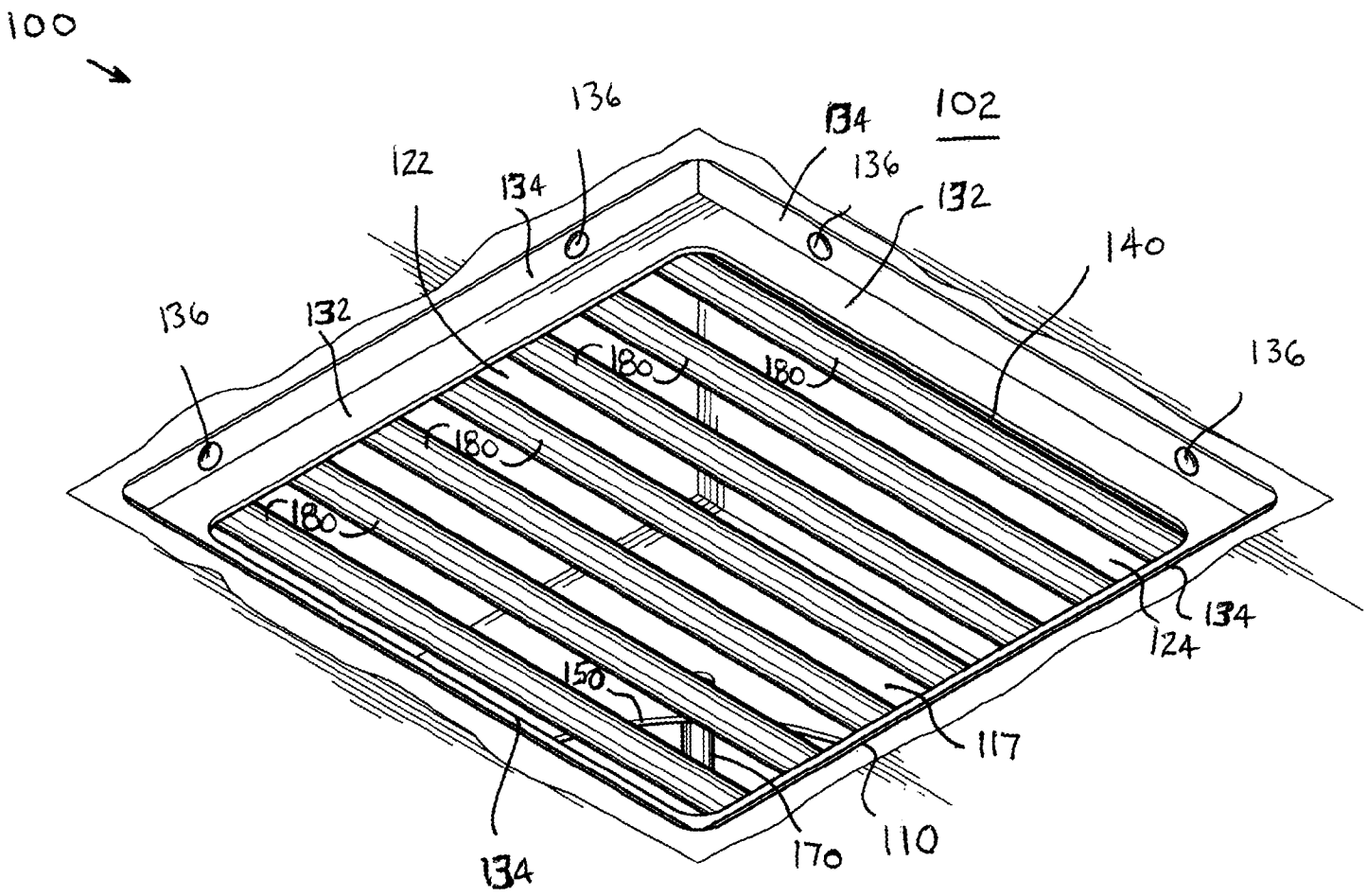
FIG. 13 is a perspective view similar to FIG. 12, but with the drain box cover removed from the drain box assembly for the sake of clarity.
Figure 14:
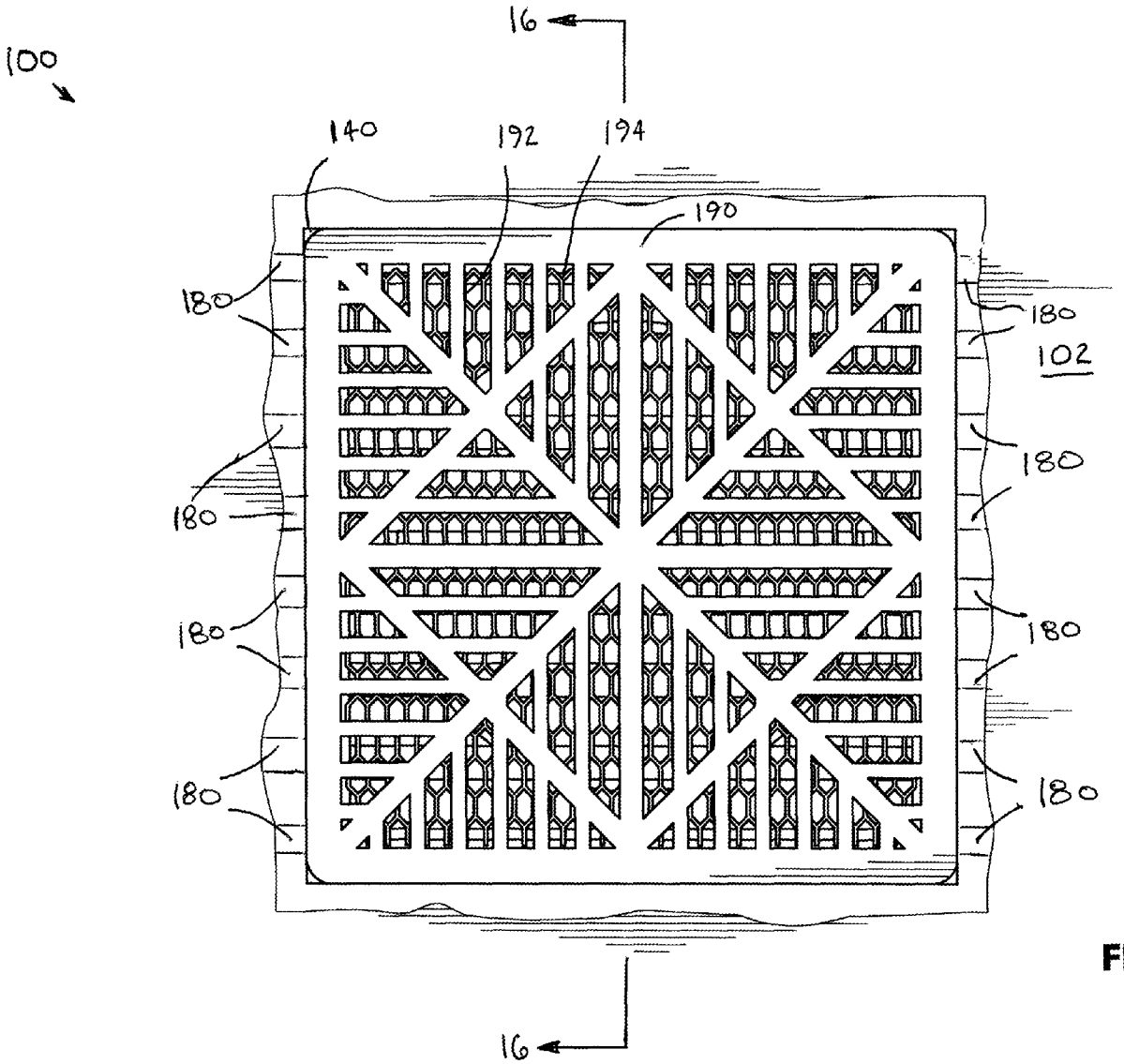
FIG. 14 is a top plan view of the illustrated embodiment of the drain box assembly of FIG. 1, installed in place in the concrete base of a convertible splash pad/ice rink structure, with a perimeter portion of the concrete base around the drain box assembly cut away for ease of illustration.
Figure 15:
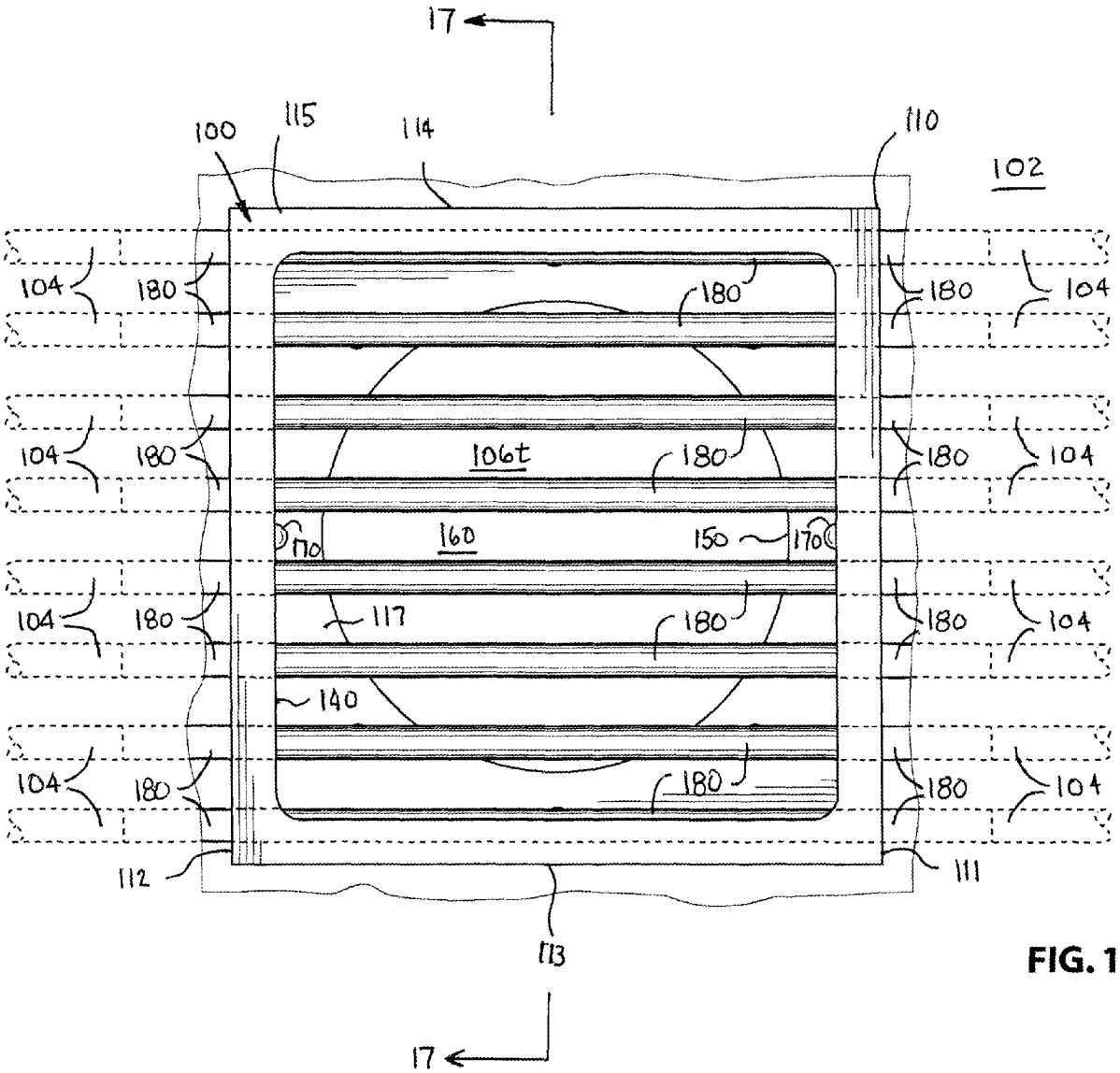
FIG. 15 is a top plan view similar to FIG. 14, but with the drain box cover removed from the drain box assembly for the sake of clarity, and with the coolant pipes below the concrete base shown in phantom outline.
Figure 16:
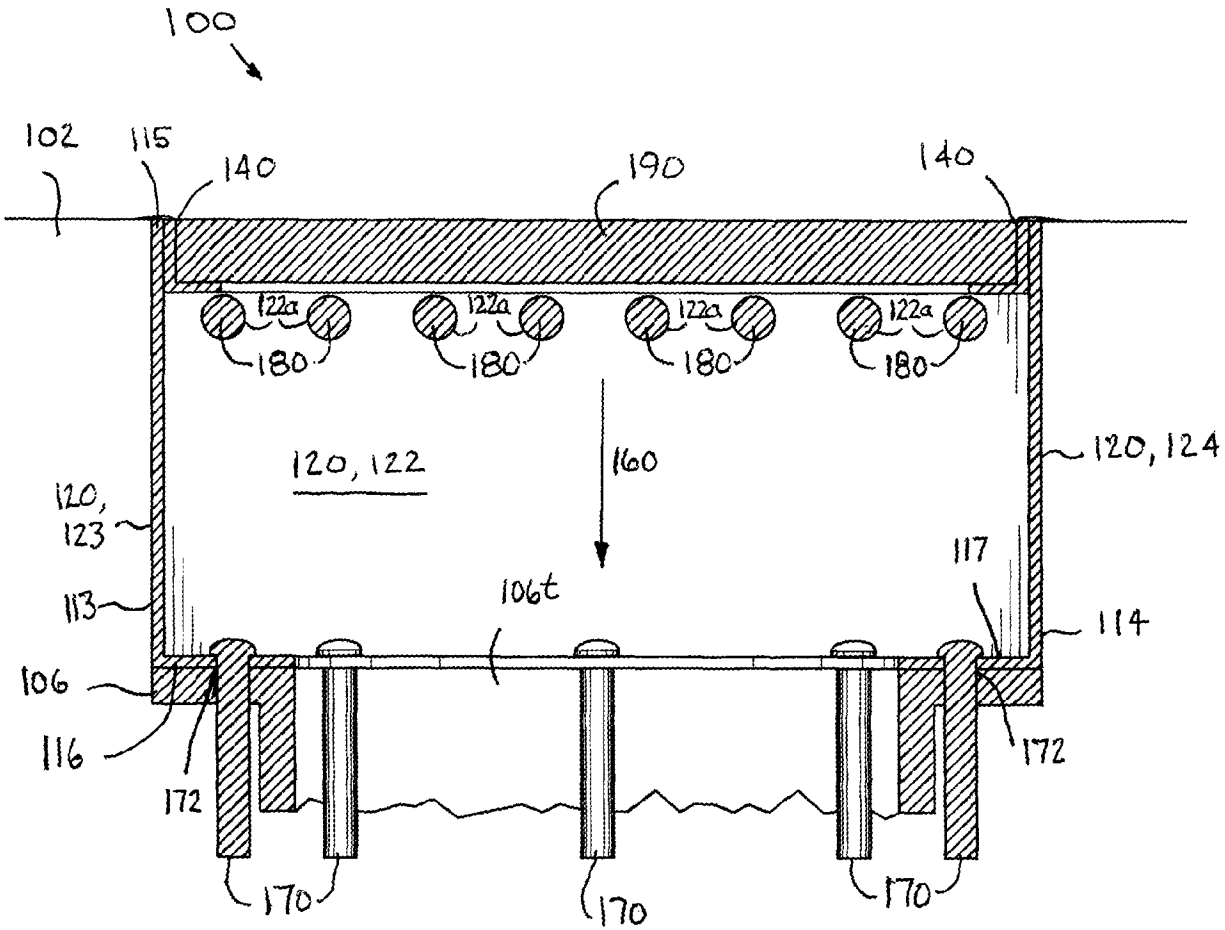
FIG. 16 is a sectional side elevational view of the illustrated embodiment of the drain box assembly of FIG. 1, installed in place in the concrete base of a convertible splash pad/ice rink structure, taken along section line 16-16 of FIG. 14.
Figure 17:
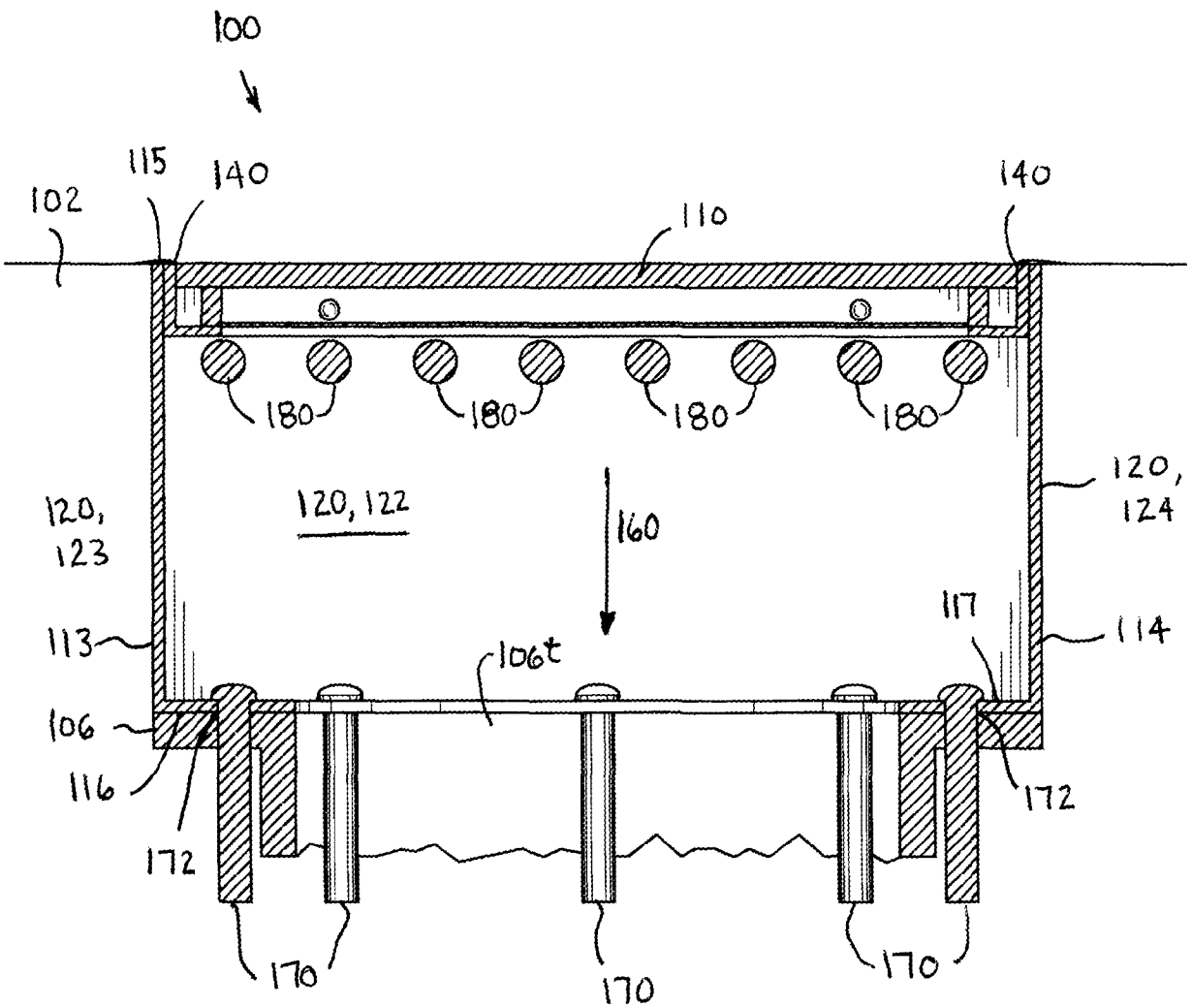
FIG. 17 is a sectional side elevational view similar to FIG. 16, but with the drain box cover removed from the drain box assembly for the sake of clarity, and taken along section line 17-17 of FIG. 15.

The drain box assembly 100 further, preferably, but not essentially, comprises at least one inwardly projecting cover-support flange 130 disposed below the top 115 of the housing 110 and above the plurality of coolant pipe segments 180 for supporting the drain box cover 190 thereon. As can be best seen in FIG. 13, the cover-support flange 130 comprises four flange portions 132 connected to the bottom of an upwardly extending circumferential mounting rim 134. The cover-support flange 130 is mounted on the inner wall surface 120*s* of the four upright walls 120 of the housing 110 at the top 115 of the housing 110 via welding or suitable fasteners (not specifically shown) extending through co-operating apertures 136 in the upwardly extending circumferential mounting rim 134 and co-operating apertures 119 in the housing 110. One flange portion 132 extends inwardly from each of the four upright walls 120 at a level designed so that the drain box cover 190 is substantially flush with the concrete base 102 of the convertible splash pad/ice rink structure, when installed therein, as shown in FIG. 12.

The water ingress port 140 is disposed adjacent the top 115 of the housing 110. More specifically, the water ingress port 140 comprises the entire top opening of housing 110, as narrowed slightly by the cover-support flange 130.

A water egress port 150 is disposed adjacent the bottom of the housing 110. More specifically, the water egress port 150 is centrally disposed in the bottom floor 117 and is, as shown, circular in shape, although any suitable shape is acceptable. As can be best seen in FIGS. 15 through 17, the water egress port 150 is in fluid communication with the top opening 106*t* of an in-ground drain pipe 106 to thereby permit water to drain from the drain box assembly 100 through the water egress port 150 and into the in-ground drain pipe 106.

The one or more upright walls 120, specifically, the first end wall 121, the second end wall 122, the first side wall 123 and the second side wall 124, connect the top 115 and bottom 116 of the housing 110 in fluid sealing relation to form within the housing 110 the vertically directed water flow channel as indicated by arrow 160 connecting the water ingress port 140 and the water egress port 150 in fluid communication one with the other.

The drain box cover 190 is positionable in supported relation on the drain box assembly 100, specifically so as to be supported by the cover-support flange 130, for precluding large objects from entering the vertically directed water flow channel 160 of the housing 110 through the water ingress port 140. As can readily be seen in the Figures, the drain box cover 190 has a plurality of water throughpassages 192 therein to permit entry of water into the housing 110 of the drain box assembly 100. Only one of the water throughpassages 192 is indicated by reference numeral 192 in each of the Figures where the water throughpassages 192 can be readily seen, for the sake of clarity. The drain box cover 190 is shown substantially quadrilaterally shaped, and more specifically is square shaped, and in this manner is shaped and dimensioned to be positionable in supported relation on the cover-support flange 130. An optional screen member 194 that precludes the entry of small debris such as coins, keys, etc., into the housing 110 of the drain box assembly 100 is shown in FIGS. 18 and 19, in place in supported relation on the cover-support flange 130 and with the drain box cover 190 placed atop on the screen member 194.

There is also provided at least one connector 170 mounted on the housing 110 for operatively securing the housing 110 at the water egress port 150 to the drain pipe 106 installed in the ground below the concrete base 102. Preferably, the at least one connector 170 comprises, for example, a plurality of fastener components, such as, for example, conventional threaded fasteners, namely bolts. The fastener components 170 depend from the bottom floor 117 of the housing 110. The fastener components 170 extend through co-operating apertures 172 in the bottom 116 of the housing 110. The apertures 172 and the fastener components 170 are preferably spaced equidistantly around the water egress port 150 in the bottom floor 117 of the housing 110. The connectors 170 could optionally take the form of a collar welded or otherwise attached to the bottom 116 of the housing 110, which collar operatively secures the housing 110 to the drain pipe 106 in a known manner.

Figure 18:
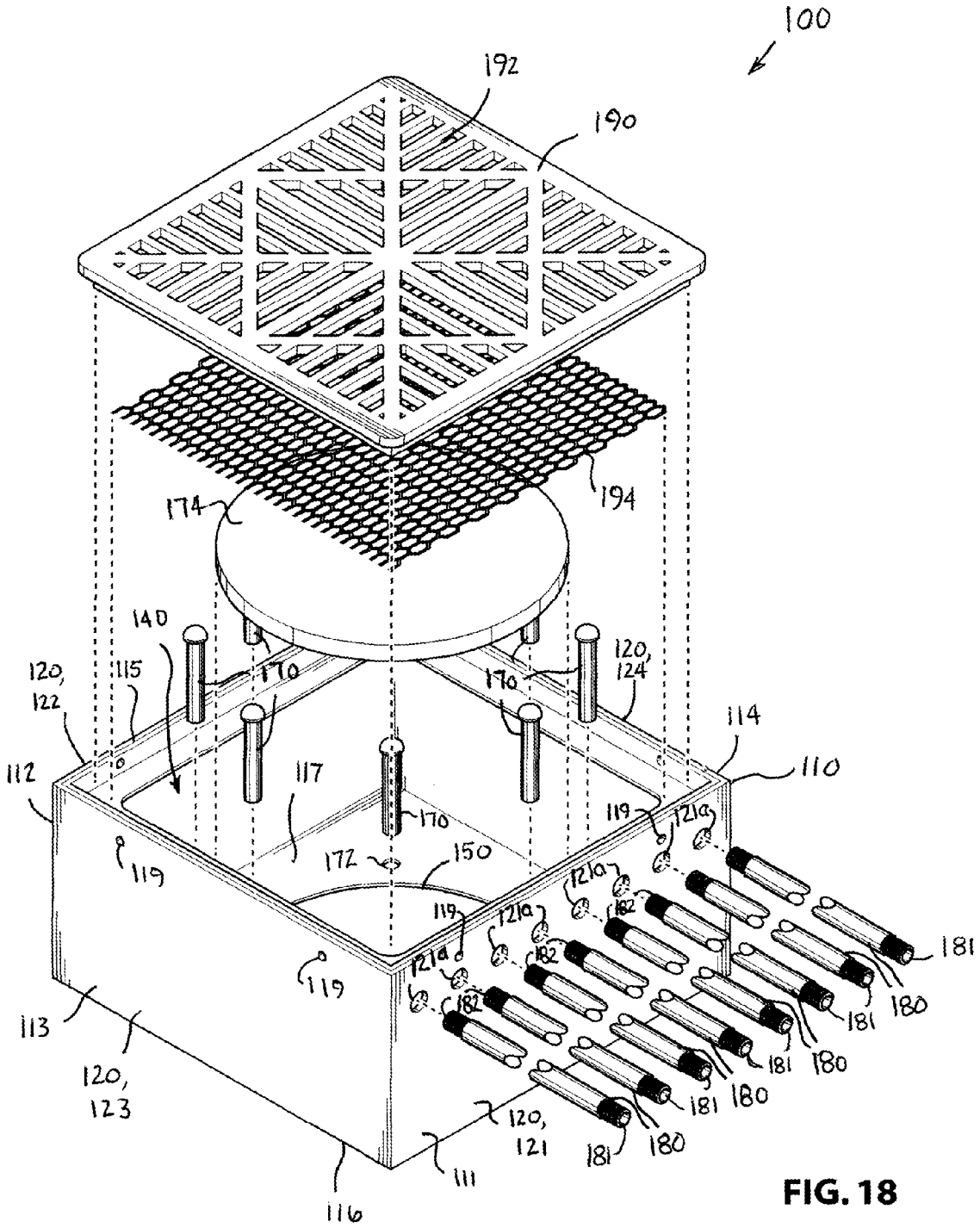
FIG. 18 is an exploded perspective view from above of the illustrated embodiment of the drain box assembly of FIG. 1, additionally showing a plug positionable in selectively removable and replaceable relation on the floor of the housing to occlude the water egress port; and, FIG. 19 is a sectional side elevational view similar to FIG. 18, and additionally showing the plug in position in selectively removable and replaceable relation on the floor of the housing to occlude the water egress port, and an amount of sand on top of the plug.
Figure 19:
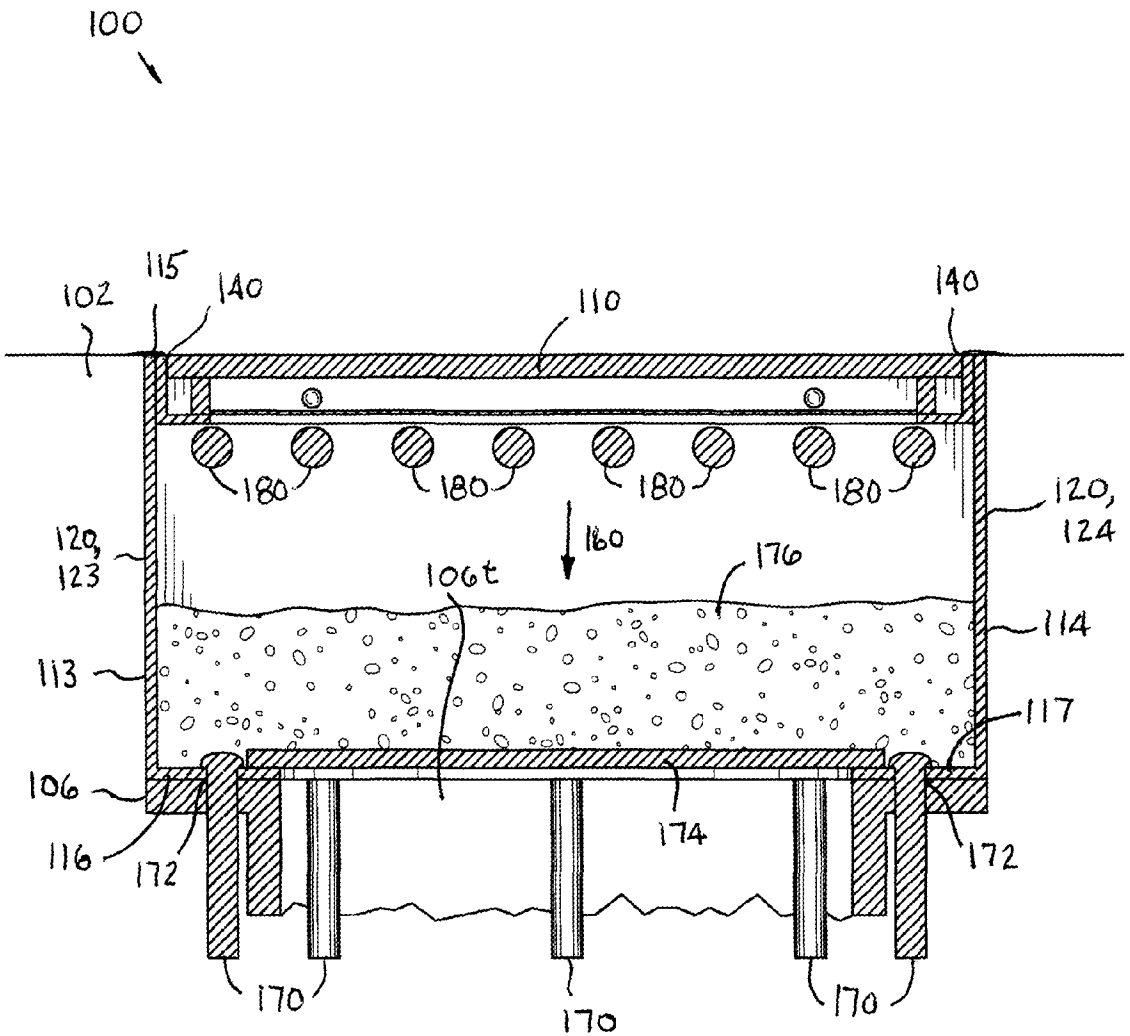

As can be best seen in FIGS. 18 and 19, the drain box assembly 100 further comprises an optional plug 174 positionable within the housing 110 in selectively removable and replaceable relation to occlude the water egress port 150, typically during the winter season when the convertible splash pad/ice rink structure 102 is flooded before freezing of the water used to form ice atop the concrete base 102. As illustrated, the plug 174 may comprise a plate shaped and dimensioned to engage the bottom floor 117 of the housing 110 in substantially sealed relation so as to cover the water egress port 150. The plug 174 need not completely seal the entry of water into the water egress port 150, but only substantially seal same, as fine sand 176 is optionally added into the housing 110 above the plug 174, so as to additionally stem the flow of water into the egress port 150, and so as to better insulate the leakage of cold from the cooling pipes 104 into the drain pipe 106. Given the fast freezing of the water used to form ice by the coolant pipes 104 after activation of the refrigeration system (not shown), and given multiple floodings of the ice surface during ice preparation, the small amount of seepage of water into the drain pipe 106 during the initial stage(s) of the ice flooding process is, with the arrangement shown, minimal and entirely acceptable.

The drain box assembly 100 further essentially comprises a plurality of coolant pipe segments 180 that connect in fluid communication to the in-ground coolant pipes 104, such that coolant flows from the in-ground coolant pipes 104 through the coolant pipe segments 180 and back into the in-ground coolant pipes 104. Preferably, the plurality of coolant pipe segments 180 comprises at least three pipe segments 180, and in the illustrated embodiment, the plurality of coolant pipe segments 180 comprises eight pipe segments 180.

Each coolant pipe segment 180 has a first open end 181 and a second open end 182 connected in fluid communication one with the other to define for each coolant pipe segment 180 an axis of symmetry "S" (see FIGS. 4 and 5) extending between the first open end 181 and the second open end 182. Further, each of the coolant pipe segments 180 is preferably, but not essentially, of substantially congruent form. More specifically, in the example illustrated, each coolant pipe segment 180 is substantially straight, but could also be any other suitable shapes and still be congruent to one another.

In the illustrated embodiment, the axis of symmetry "S" of each coolant pipe segment 180 is substantially straight, such that each coolant pipe segment 180 is, substantially parallel to the adjacent coolant pipe segment 180. Further, the axis of symmetry "S" for each coolant pipe segment 180 is substantially evenly spaced one from the next, and all are in a common plane. Preferably, the common plane is a generally horizontally oriented plane, positioned at a horizontal height that is substantially level with the horizontal height of the cooling pipes 104 to facilitate installation of the drain box assembly 100 as shown in the Figures.

The plurality of coolant pipe segments 180 are each mounted on the housing 110 so as to extend through the vertically directed water flow channel 160, adjacent the top 115 of the housing 110. More specifically, the plurality of coolant pipe segments 180 are each mounted in substantially transverse relation to the vertical water flow channel 160, with the first and second open ends 181, 182 of each coolant pipe segment 180 extending beyond the one or more upright walls 120. More particularly, as illustrated, the coolant pipe segments 180 are mounted on the housing 110 to present the first open end 181 of the coolant pipe segments 180 adjacent the first end of the housing 110, or in other words adjacent the first end wall 121 of the housing 110, for connection in fluid communication to the in-ground coolant pipes 104 and the second open end 182 of the coolant pipe segments 180 adjacent the opposite second end of the housing 110, or in other words adjacent the second end wall 122 of the housing 110, for connection in fluid communication to the in-ground coolant pipes 104.

Each of the coolant pipe segments 180 may be threaded (not shown) at the first open end 181 and may be threaded at the second open end 182 for connecting the coolant pipe segments 180 to co-operating in-ground coolant pipes 104 using co-operating threaded connectors in a conventional manner. The coolant pipe segments 180 are preferably each made from a suitable anti-corrosive metal material, such as stainless steel or brass. Any other conventional form of pipe connection means may also be used to connect the pipe segments 160 to the inground coolant pipes 104 in operatively sealed relation, including, by way of non-limiting example, hose barb couplings, which are particularly useful where the in-ground coolant pipes 104 are constructed from plastics, as aforesaid.

The drain box assembly 100 further comprises a plurality of first apertures 121*a* in the housing 110, one first aperture 121*a* for each of the coolant pipe segments 180, and a plurality of second apertures 122*a* in the housing 110, one second aperture 122*a* for each of the coolant pipe segments 180. More specifically, the plurality of first apertures 121*a* are in the first end wall 121 of the housing 110, and the plurality of second apertures 122*a* are in the second end wall 122 of the housing 110, thereby accommodating the plurality of coolant pipe segments 180 extending through the vertically directed water flow channel 160 of the housing 110. The coolant pipe segments 180 are, in the illustrated embodiment, inserted into the housing 110 by being slid into place through the first apertures 121*a* and the second apertures 122*a*.

As can be readily seen, having the cooling pipe segments 180 extend through the vertically directed water flow channel 160 of the housing 110 of the drain box assembly 100 according to the present invention, adjacent the top 115 of the housing 110, provides for even cooling of an ice surface disposed immediately above the drain box assembly 100. Accordingly, the "warm spots" in the ice formed above the drain box assemblies 100 during the skating season are eliminated, as the regular spacing of the in-ground coolant pipes 104 is, unlike the prior art, effectively maintained across the top 115 of the housing 110.

This concludes the description of but one exemplary embodiment of the invention. Many modifications and variations are possible in light of the above teaching and will be apparent to those skilled in the art. For instance, the housing could be formed in two separate sections, namely an upper section and a lower section. Preferably, the apertures that receive the cooling pipe segments would be formed partially in the upper section and partially in the lower section. During installation, the lower section of the housing would be installed, the cooling pipe segments would be put in place in the portions of the apertures in the lower section and also connected to the in-ground coolant pipes, and then the upper section of the housing would be installed, such that the coolant pipe segments fit into and are retained in place by the portions of the apertures positioned in the upper section of the housing.

The scope of the claims appended hereto should not be limited by the illustrated embodiment set forth in the Figures and described above, but should be given the broadest interpretation consistent with the description as a whole.

I claim:

1. A drain box assembly for a convertible splash pad/ice rink structure having a plurality of in-ground coolant pipes, said drain box assembly comprising:

a housing having an open top and a bottom portion, a water ingress port formed by the open top of the housing and a water egress port in the bottom portion of the housing, with one or more upright walls connecting the open top and bottom portion of the housing in fluid sealing relation to form within the housing a vertically directed water flow channel connecting said water ingress port and said water egress port in fluid communication with each other;

at least one connector mounted on said housing for operatively securing said housing at said water egress port to a drain pipe installed in the ground; and, a plurality of coolant pipe segments, each coolant pipe segment having a first open end and a second open end connected such that the first open end and the second open end are in fluid communication with each other to define for each coolant pipe segment an axis of symmetry extending between said first open end and said second open end;

said plurality of coolant pipe segments each being mounted on said housing so as to extend across the housing adjacent the open top and through said vertically directed water flow channel, in transverse relation to said vertical water flow channel, with the first and second open ends of each coolant pipe segment extending beyond said one or more upright walls;

wherein, when the convertible splash pad/ice rink is used as an ice rink, said plurality of coolant pipe segments contain coolant to provide cooling of the open top of the drain box assembly.

2. The drain box assembly of claim 1, wherein said plurality of coolant pipe segments comprises at least three pipe segments.

3. The drain box assembly of claim 1, wherein the axes of symmetry for said coolant pipe segments are in a common plane.

4. The drain box assembly of claim 3, wherein said common plane is horizontally oriented.

5. The drain box assembly of claim 4, wherein the axis of symmetry of each of said coolant pipe segments is straight.

6. The drain box assembly of claim 4, wherein the axes of symmetry for said coolant pipe segments are parallel to adjacent coolant pipe segments.

7. The drain box assembly of claim 6, wherein the axes of symmetry for each pair of said adjacent coolant pipe segments are evenly spaced.

8. The drain box assembly of claim 7, wherein each of said coolant pipe segments is of congruent form.

9. The drain box assembly of claim 8, wherein said housing has a first end and a second end, and said coolant pipe segments are mounted on said housing to present the first open ends of said coolant pipe segments adjacent the first end of said housing for connection in fluid communication to said in-ground coolant pipes and the second open ends of said coolant pipe segments adjacent the second end of said housing for connection in fluid communication to said in-ground coolant pipes.

10. The drain box assembly of claim 9, further comprising a plurality of first apertures in said housing, one first aperture for each of said coolant pipe segments, and a plurality of second apertures in said housing, one second aperture for each of said coolant pipe segments.

11. The drain box assembly of claim 10, wherein each of said coolant pipe segments is threaded at said first open end and is threaded at said second open end for connecting to co-operating in-ground coolant pipes.

12. The drain box assembly of claim 11, wherein said coolant pipe segments are each made from a suitable anti-corrosive metal material.

13. The drain box assembly of claim 12, wherein said housing is made from a suitable anti-corrosive metal material.

14. The drain box assembly of claim 13, wherein the bottom portion of said housing includes a bottom floor, and said water egress port is disposed in said bottom floor.

15. The drain box assembly of claim 14, wherein said at least one connector comprises a plurality of fastener components.

16. The drain box assembly of claim 15, wherein said fastener components depend from the bottom floor of said housing.

17. The drain box assembly of claim 16, wherein said fastener components extend through co-operating apertures in the bottom floor of said housing.

18. The drain box assembly of claim 17, wherein said fastener components are spaced equidistantly around the water egress port in the bottom floor of the housing.

19. The drain box assembly of claim 1, further comprising a drain box cover positionable in supported relation on said drain box for precluding solid objects from entering the vertically directed water flow channel of said housing while allowing water to freely pass therethrough.

20. The drain box assembly of claim 19, further comprising at least one inwardly projecting cover-support flange disposed below the open top of said housing and above said plurality of coolant pipe segments for supporting said drain box cover thereon, and with said drain box cover being shaped and dimensioned to be positionable in supported relation on said cover-support flange.

21. The drain box assembly of claim 20, wherein said housing is rectangular and said one or more upright walls comprises four upright walls, and said cover-support flange comprises four flange portions, with one flange portion extending inwardly from each of said four upright walls, and wherein said drain box cover is correspondingly rectangular to be received on said four flange portions.

22. The drain box assembly of claim 14, further comprising a plug positionable on said housing in selectively removable and replaceable relation to occlude said water egress port.

23. The drain box assembly of claim 22, wherein said plug comprises a plate shaped and dimensioned to engage the top surface of the bottom floor in sealed relation, and cover said water egress port.

* * * * *